US006215253B1

(12) United States Patent
Ribarich et al.

(10) Patent No.: US 6,215,253 B1
(45) Date of Patent: Apr. 10, 2001

(54) INDUCTORLESS BALLAST

(75) Inventors: Thomas J. Ribarich, Laguna Beach; John J. Ribarich, Los Angeles, both of CA (US)

(73) Assignee: International Rectifier Corporation, DE (US)

( * ) Notice: Subject to any disclaimer, the term of this patent is extended or adjusted under 35 U.S.C. 154(b) by 0 days.

(21) Appl. No.: 09/328,585

(22) Filed: Jun. 10, 1999

Related U.S. Application Data

(60) Provisional application No. 60/088,834, filed on Jun. 10, 1998.

(51) Int. Cl.[7] ..... H05B 37/02
(52) U.S. Cl. ..... 315/224; 315/291
(58) Field of Search ..... 315/224, 307, 315/242, 291, DIG. 5, 209 R, DIG. 7

(56) References Cited

U.S. PATENT DOCUMENTS 4,633,161 * 12/1986 Callahan et al. ..... 323/242
5,365,148 * 11/1994 Mallon et al. ..... 315/194
5,550,440 * 8/1996 Allison et al. ..... 315/294

* cited by examiner

*Primary Examiner*—Don Wong
*Assistant Examiner*—Chuc Tran D.
(74) *Attorney, Agent, or Firm*—Ostrolenk, Faber, Gerb & Soffen, LLP

(57) ABSTRACT

An inductorless ballast including four transistors arranged in a full-bridge configuration for supplying a high voltage AC step-type signal across a fluorescent lamp. The circuit of the present invention eliminates the need for an inductor, thereby resulting in a smaller, lighter and more reliable ballast which can fit into a fluorescent lamp socket.

8 Claims, 8 Drawing Sheets

INDUCTORLESS BALLAST

This application claims the benefit of U.S. Provisional Application Ser. No. 60/088,834, filed Jun. 10, 1998, the disclosure of which is incorporated herein by reference.

BACKGROUND OF THE INVENTION

1. Field of the Invention

The present invention relates to an inductorless ballast. More specifically, the present invention relates to an inductorless ballast for a fluorescent light.

2. Description of the Prior Art

Existing solutions for driving a fluorescent lamp at high-frequency include some form of current limiting, or "ballast," between the high-frequency voltage source (usually a pair of transistors arranged in a half-bridge circuit) and the lamp. The ballast may be a resistor (when driving the lamp at D.C.) or an inductor or capacitor (when driving the lamp at high-frequency). These passive components provide a frequency dependent impedance for current limiting and provide smooth, quasi-sinusoidal lamp voltage and current waveforms. The frequency of operation of the ballast is much higher than the ionization time constant of the lamp, therefore eliminating any re-strike during each cycle of lamp voltage.

Conventional ballasts for fluorescent lamps, which typically incorporate an inductor for driving the lamp at high-frequency, are bulky, heavy and unreliable. It would be desirable to provide an inductorless ballast for high frequency fluorescent lamp operation which does not have the above-mentioned disadvantages.

SUMMARY OF THE INVENTION

The present invention provides an inductorless ballast for driving a load, such as a fluorescent lamp, with an AC step-type voltage waveform generated by a full-bridge circuit formed of switching transistors such as power MOSFETs, for example. The circuit utilizes the physical properties of the fluorescent lamp, such as the ionization time constant and the resistance of the lamp, for control.

The circuit drives the lamp with high frequency AC step-type voltage and current waveforms or other optimized lamp waveforms (e.g., elliptical rather than step-type). The circuit of the present invention utilizes an efficient control means for controlling lamp power (i.e., lamp brightness) by independently varying "on" and "off" time of the voltage applied to the lamp (and thereby controlling the operating frequency and the duty-cycle), and also by varying the amplitude of the applied voltage waveform. Rms, average or peak lamp current are sensed and controlled for controlling lamp power.

The AC step-type waveform generated by the circuit of the present invention provides minimum lamp current crest factor (~1) and maximum power factor (phase shift between lamp voltage and current ~0), therefore maximizing lamp life. The present inventive circuit also utilizes the ionization constant of the lamp to achieve high-frequency switching (lamp acts as a pure resistor) and to prevent lamp power and current from running away exponentially. Also, the circuit achieves a reduction in electromagnetic interference (EM1), ringing or harmonies produced during switching by utilizing the ionization time constant of the lamp along with proper snubbing techniques.

The circuit provides the potential for direct AC line operation without rectification and power factor correction.

The circuit also utilizes the resistance of the lamp to achieve zero-voltage switching by commutating the voltage across each switch through the lamp to zero during a predetermined deadtime before turning the appropriate switch on.

Advantageously, the circuit of the present invention could fit into the base of the lamp socket in the case of compact fluorescent lamps where the ballast and lamp are combined into one package, or, into one of the sockets holding the ends of the lamp in a fixture where the ballast is separate from the lamp. The circuit results in a substantial reduction in size, weight, and increases reliability and manufacturability.

In addition, the present invention eliminates the need for an inductor, PCB or other external components necessary with existing solutions.

Other features and advantages of the present invention will become apparent from the following description of the invention which refers to the accompanying drawings.

DETAILED DESCRIPTION OF THE PREFERRED EMBODIMENTS

Overview

Figure 1:
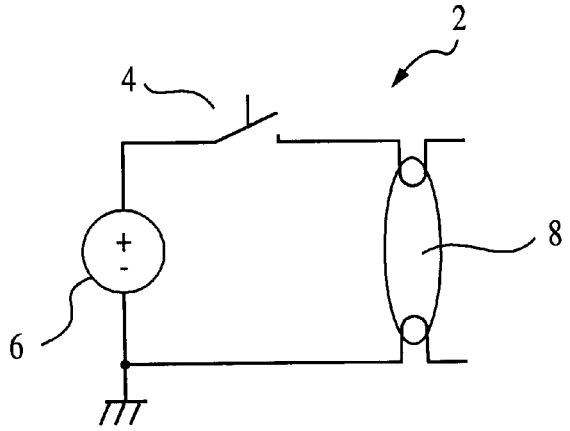
FIG. 1 is a simplified diagram representing a lamp being driven by a voltage source and a switch.

The basic operation of the present invention will be explained starting with an overview using a simplified lamp driving circuit 2 (FIG. 1), where a switch 4 is placed between a constant voltage source 6 and a lamp 8.

Lamp 8 produces light as a result of electrical power, $P_L$, flowing through the lamp. The electrical power excites and ionizes mercury atoms the mercury atoms being momentarily driven into an unstable, higher energy state. When the excited mercury atoms return to a lower energy state, UV light is radiated. The UV radiation is then converted into visible light by a fluorescent powder (in nanoseconds) coated onto the inside of the fluorescent bulb.

Everything in the process occurs very rapidly, except for the generation of ionized mercury atoms from electrical power, which is a relatively slow conversion (~1 ms). Because the ionization density is related to the instantaneous lamp power by a "running average", the describing function for the lamp is given as:

$$\overline{P_L}(s) = \frac{1}{1+\tau s} P_L(s) \tag{1}$$

where, $P_L$=running average power $\tau$=ionization/recombination time constant $\overline{P}_L$=instantaneous lamp power In the time domain, equation [1] becomes:

$$P_L(t) = \overline{P_L}(t) + \tau \frac{d\overline{P_L}(t)}{dt} \tag{2}$$

Accordingly, $\overline{P}_L$ is the low-pass-filtered equivalent of the instantaneous lamp power, and the filter has a time constant $\tau$.

The average power $\overline{P}_L$ can be solved for when switch 4 is closed and when switch 4 is open.

The solutions yield the following:

$0 \leqq t \leqq t_1$ (switch 4 closed):

$$\overline{P_L} = \overline{P_{L_{0+}}} e^{\left(\frac{V^2}{V_{LAMP}^2}-1\right)\frac{t}{\tau}} \tag{3}$$

$t_1 \leqq t \leqq t_2$(switch 4 open):

$$\overline{P_L} = \overline{P_{L_{0-}}} e^{-\frac{t}{\tau}} \tag{4}$$

where, $\overline{P_{L_{0+}}}$=initial condition on average power before switch 4 is closed $\overline{P_{L_{0-}}}$=initial condition on average power before switch 4 is opened $V_{LAMP}$=effective rated running lamp voltage.

When plotted versus time, the exponential increase and decrease in $\overline{P}_L$ (FIG. 2) can be seen as switch 4 is opened and closed at a certain frequency and a duty cycle.

Figure 2:
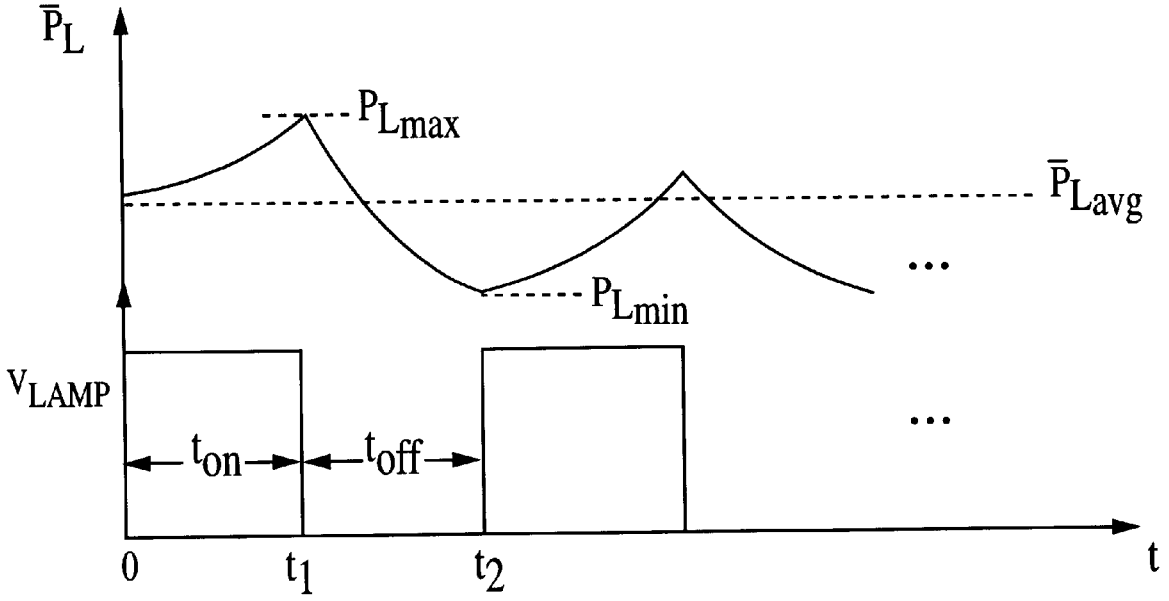
FIG. 2 is a graph showing the average running lamp power and voltage.

The final average of these averages is given as:

$$\overline{P_{L_{AVG}}} = \frac{D}{t_{on}}\left[\int_0^{\tau_1} P_{L_{\min}} e^{\left(\frac{V^2}{V_{LAMP}^2}-1\right)\frac{t}{\tau}dt} + \int_0^{\tau_2} P_{L_{\max}} e^{-\frac{t}{\tau}dt}\right] \tag{5}$$

where,

D=duty cycle $P_{Lmin}$=minimum average (FIG. 2)

$P_{Lmax}$=maximum average (FIG. 2)

From equation (5) it can be seen that the average lamp power, while driving the lamp with a square wave voltage, can be controlled and predicted using frequency, duty-cycle and/or input voltage level.

Further, equation (3) shows that a minimum voltage must be supplied to the lamp ($V>V_{LAMP}$); otherwise, the power will not increase and the lamp will extinguish. This can be seen when driving a lamp at low frequency, where a 're-strike' voltage peak occurs at each zero-crossing of the AC line voltage supplying the coil/core ballast.

In addition, the power in the lamp will "run away" exponentially until the lamp is damaged, unless the switch is opened for a portion of the cycle and the power is allowed to decrease (FIG. 2).

With the switch open, the lamp current and voltage go instantaneously to zero, but the lamp remains lit. This is because of the ionization time constant, during which the lamp will remain lit until the electrons recombine with the gas atoms. The switching frequency must therefore be much higher than the ionization time constant.

Figure 3:
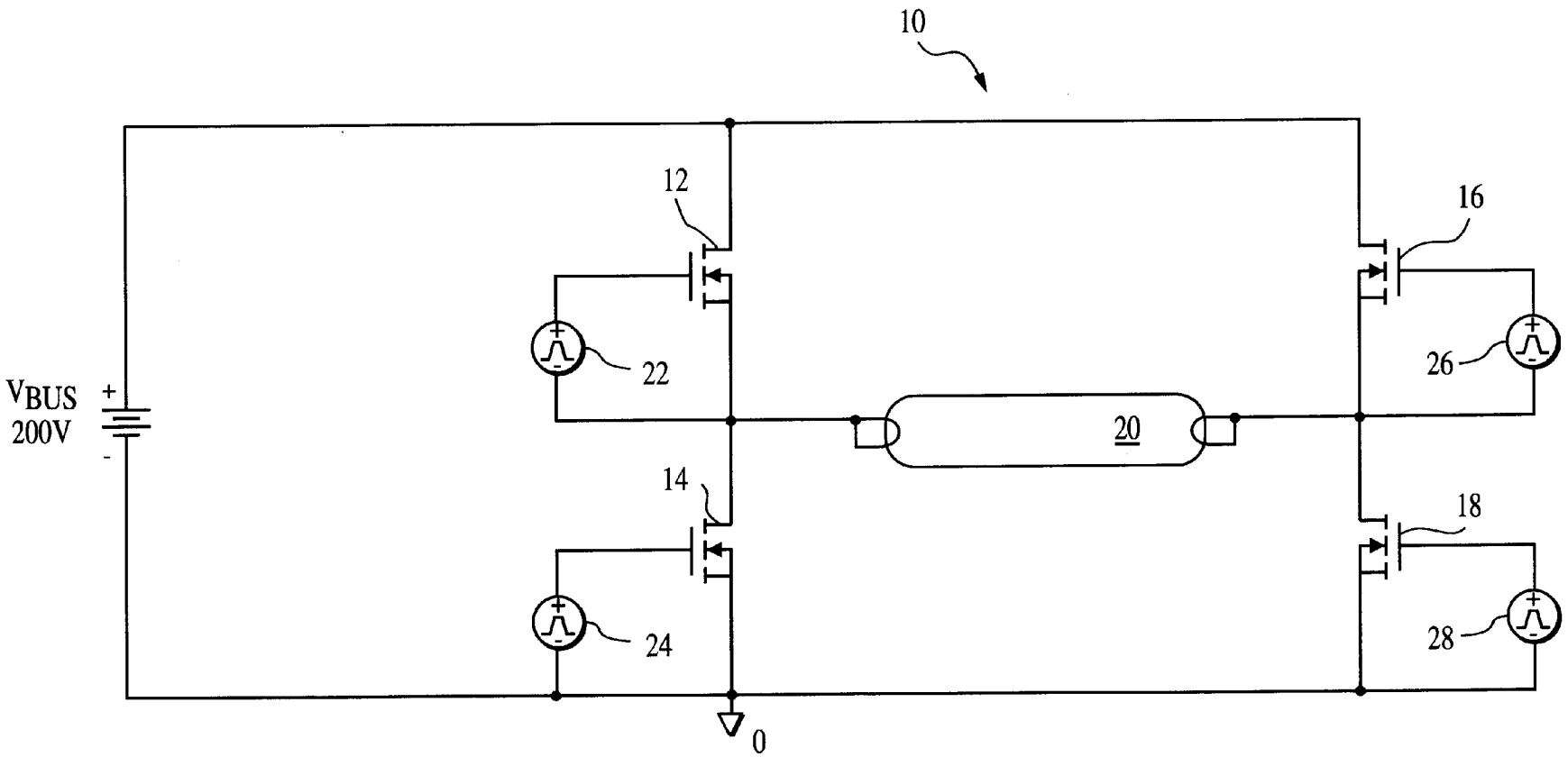
FIG. 3 is a schematic diagram of a simplified inductorless ballast circuit according to the present invention.
Figure 5:
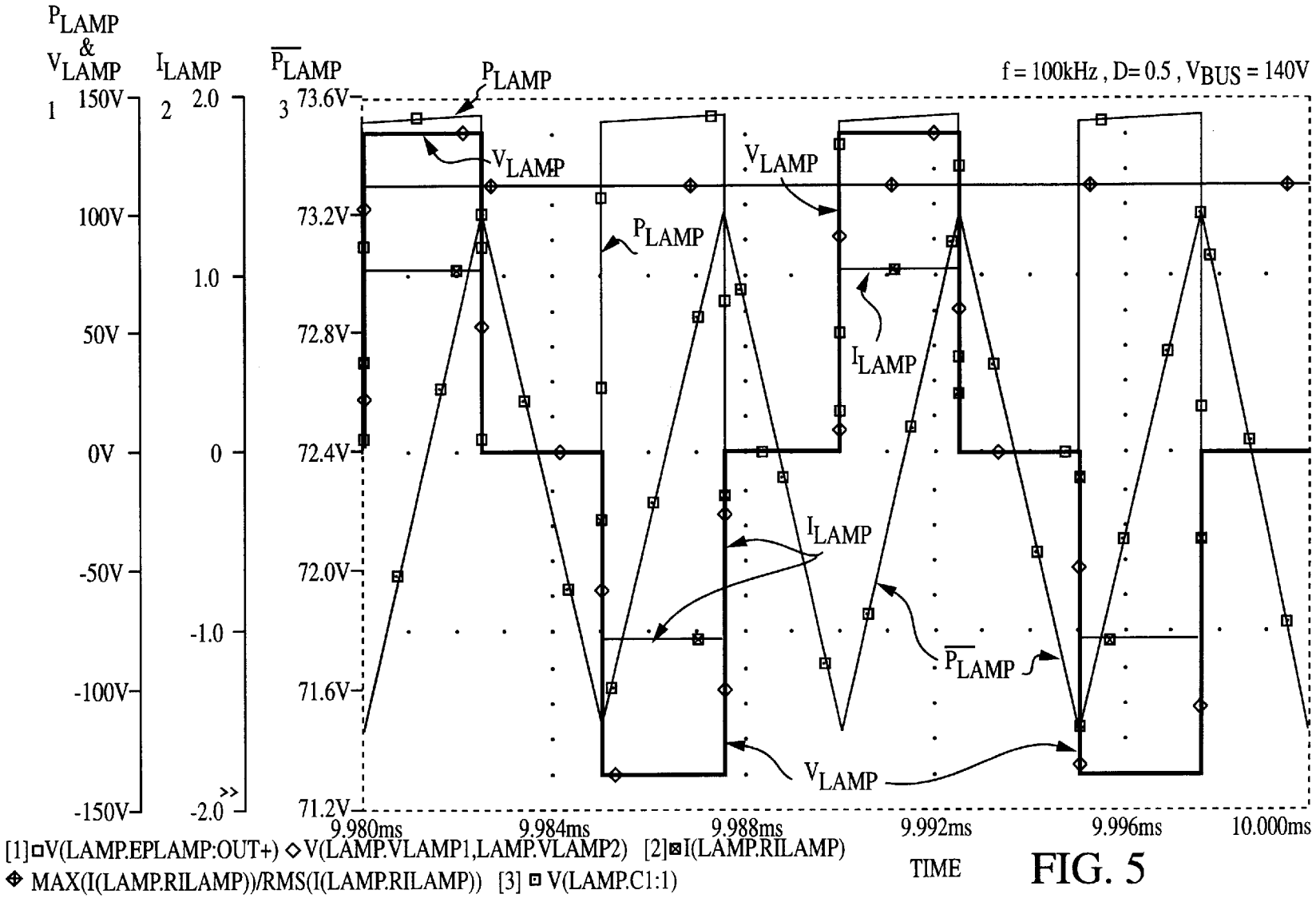
FIGS. 5 and 6 are timing diagrams for the inductorless ballast of the present invention.

A simplified circuit 10 of the present invention is shown in FIG. 3, with corresponding waveforms being shown in FIG. 5. The circuit consists of a full-bridge configuration in which a bus voltage $V_{BUS}$ is supplied by switching transistors such as MOSFETS 12, 14, on one side of lamp 20, and by MOSFETS 16 and 18 on the opposite side of the lamp 20. (Although the switching transistors are identified in the following description as MOSFETs, those of skill in the art will recognize that IGBTs or other switching transistors could also be used to implement the circuit of the present invention.) Respective square wave voltage sources 22, 24, 26, and 28 are provided to supply a gating voltage to each of the MOSFETs.

Operationally, MOSFETs 12 and 18 are 'on' when MOSFETs 14 and 16 are 'off,' and MOSFETs 12 and 18 are 'off' when MOSFETs 14 and 16 are 'on.' A deadtime between each transition is necessary to prevent a short-circuit of the DC bus. Due to the full bridge configuration of the switching MOSFETs, the voltage applied to the lamp goes positive and negative in equal amounts with an "off" time (i.e., 0 volts) in between. The result is that the voltage applied to the lamp has an "AC step-type" waveform, labelled as $V_{LAMP}$ and shown in bold in FIG. 5.

The switching transitions occur as follows (starting with MOSFETs 12 and 18 'on'):

First, MOSFET 18 turns 'off,' allowing the source of MOSFET 16 to commute to the DC bus. MOSFET 12 is then turned 'off' and MOSFET 16 can now be closed while achieving zero-voltage switching. MOSFET 14 is then closed and the lamp 20 conducts in the opposite direction as the previous half-switching cycle.

The full bridge allows AC current to flow through the lamp, thereby preventing mercury migration to either lamp end.

The waveforms of FIG. 5 show the frequency and duty-cycle varying to keep the average lamp power stable. Accordingly, a balance between the 'on' time and 'off' time is necessary to prevent the lamp power from running away (increasing until something fails), as previously shown mathematically in connection with FIG. 2.

The 'on' time is a function of the DC bus voltage level and the 'off' time is a function of how far above some desired level the current is. Accordingly, there are two independent loops.

Figure 4:
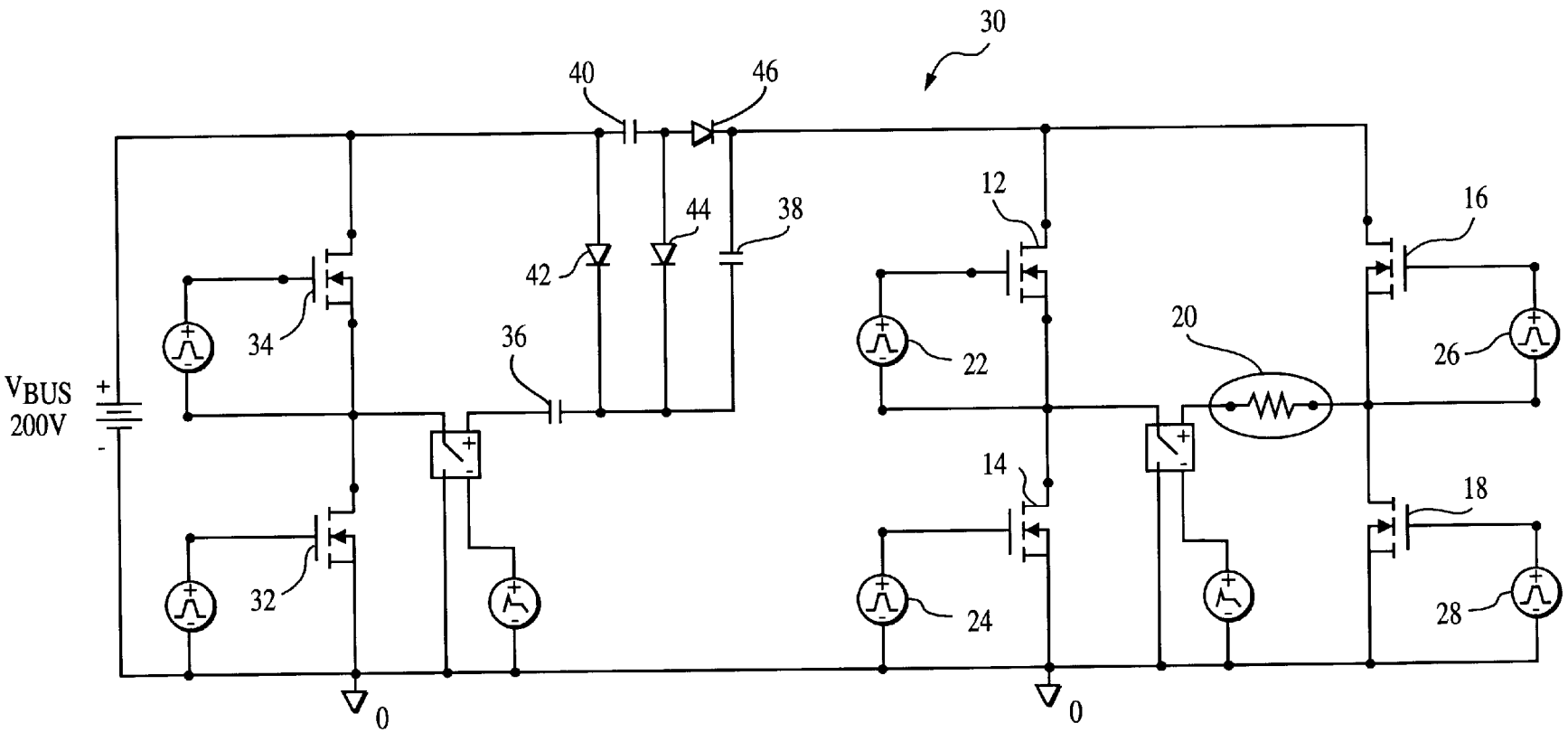
FIG. 4 is a more detailed schematic diagram of the inductorless ballast of the present invention including the ignition circuitry.
Figure 6:
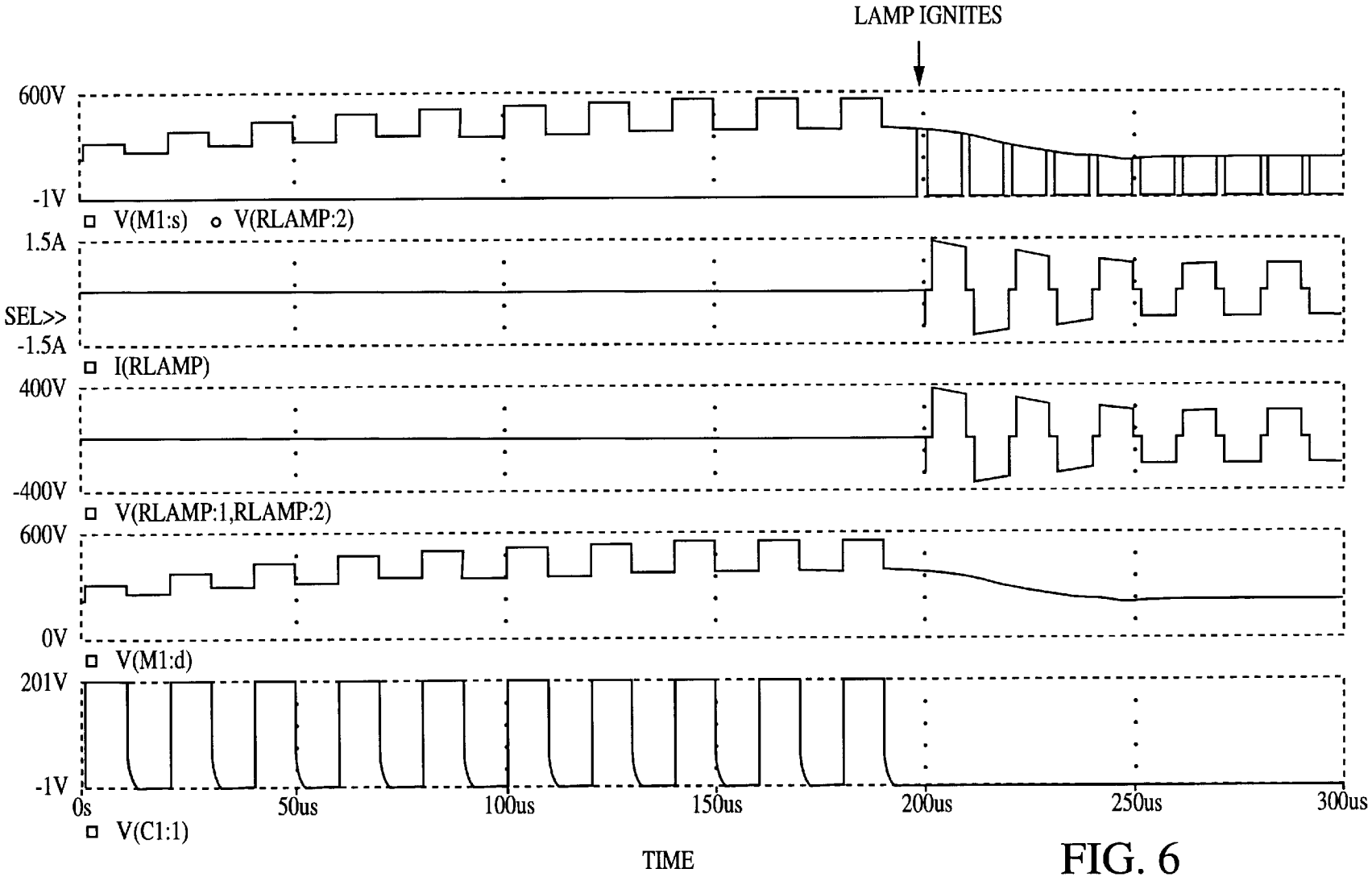

FIG. 4 shows a more detailed schematic of the full-bridge circuit 30 of the present invention which includes ignition circuitry. Referring to the timing diagram of FIG. 6, MOSFETs 32 and 34 are initially oscillating at a fixed frequency/50% duty-cycle, until the charge pump (capacitors 36, 38, 40, and diodes 42, 44, 46) provides enough voltage across the lamp 20 and the lamp strikes. At this point, MOSFETs 32 and 34 are both turned 'off' and the full-bridge regulates lamp power substantially as described above with reference to FIG. 3.

Figure 7:
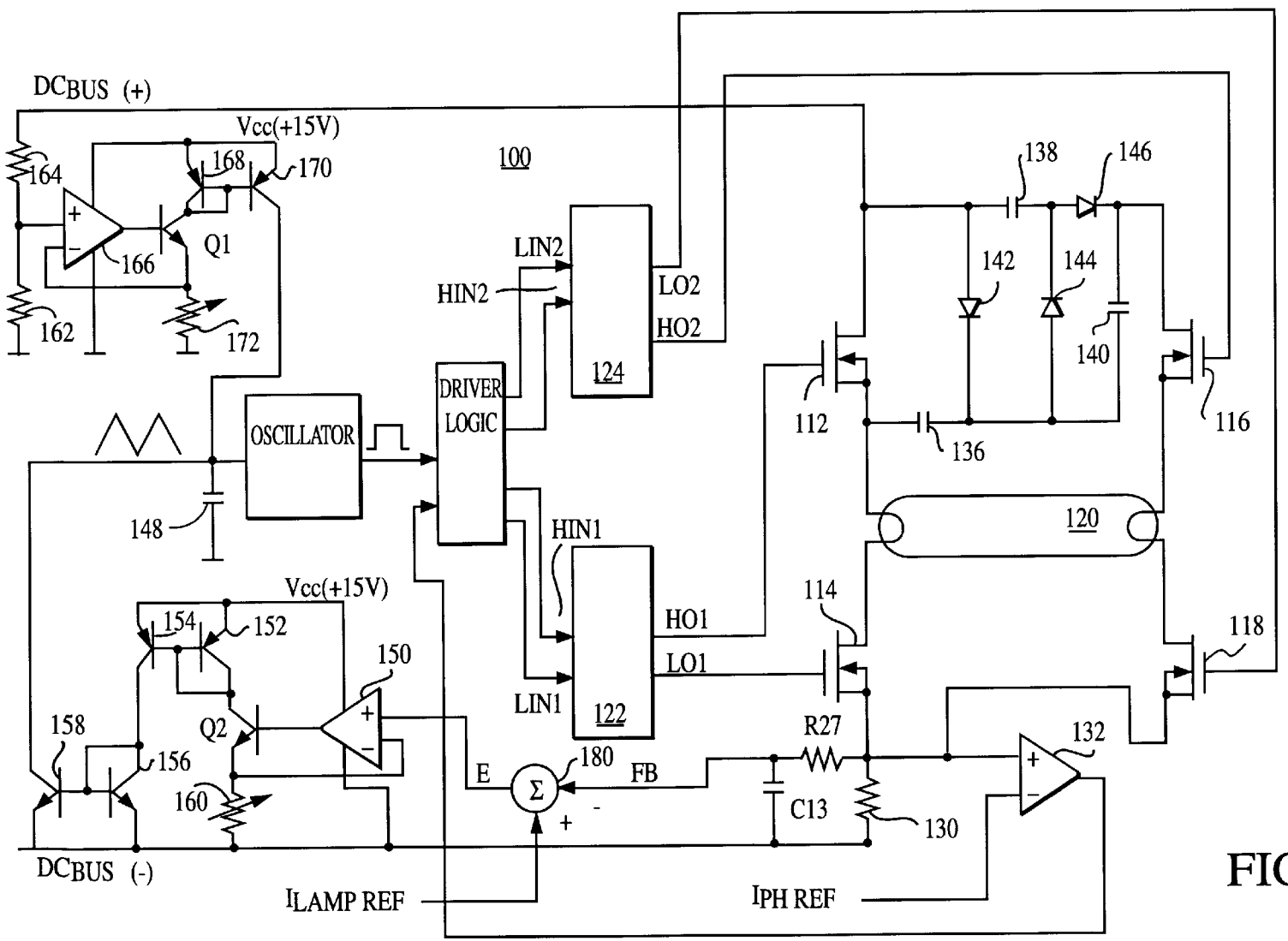
FIG. 7 is a schematic diagram of an inductorless ballast circuit of the present invention, including circuitry for switching between preheat, ignition and run modes.

Referring to FIG. 7, a schematic of a further embodiment of an inductorless ballast circuit 100 according to the present invention is shown. Circuit 100 includes componentry for three modes of operation: preheat, ignition, and running. As can be seen from the timing diagram of FIG. 8, each of the three modes of operation requires slightly different on/off control of the full-bridge switches 112, 114, 116, and 118.

In circuit 100, gate voltage sources have been replaced by half bridge drivers 122 and 124.

Preheat

During preheat, LO1 and LO2 of half bridge drivers 122 and 124 are both logic 'high,' and HO1 and HO2 are pulsed on and off depending on the lamp filament preheat current measured across sense resistor 130. MOSFETs 114 and 118 are alternatively turned on until the peak current measured across 130 exceeds a preheat current reference threshold, $I_{PHREF}$.

At this time, comparator 132 instructs the driver logic to turn MOSFET 114 off, for example, and turn MOSFET 118 on until the peak current exceeds the $I_{PH}$ threshold again. MOSFET 114 and 118 alternate until a pre-determined preheat time has been reached, indicating that the filaments have been adequately heated, and the circuit initiates IGNITION.

Figure 9:
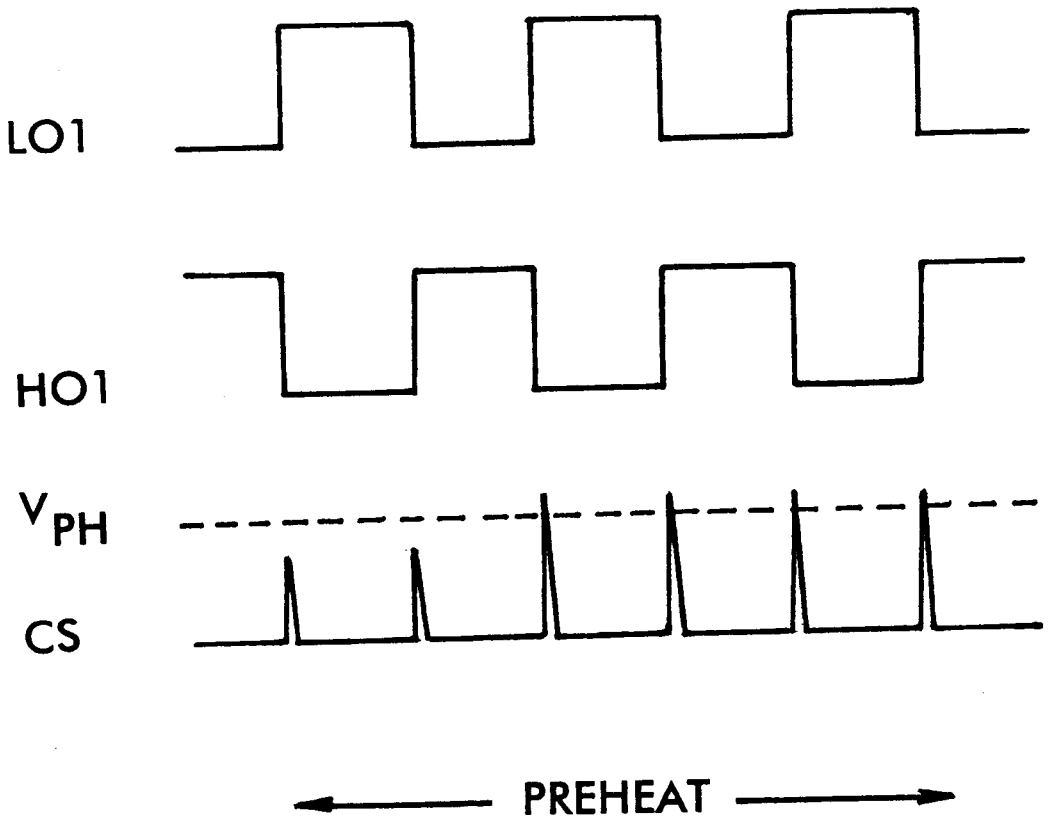
FIG. 9 is a timing diagram of an alternative preferred method for igniting the lamp with the circuit of the present invention.

Alternatively, and preferably, the preheat circuitry can be designed such that, rather than being held "high," LO1 and LO2 are switched in alternate fashion with HO1 and HO2, respectively, with the deadtime decreased to approach zero. As shown in FIG. 9, when the deadtime approaches zero (such that both the upper and lower MOSFETs conduct simultaneously), "shoot-through" occurs, resulting in an current spike (through the MOSFETs and through the lamp filaments), which crosses the threshold $V_{PH}$, leading to IGNITION.

Ignition

Figure 8:
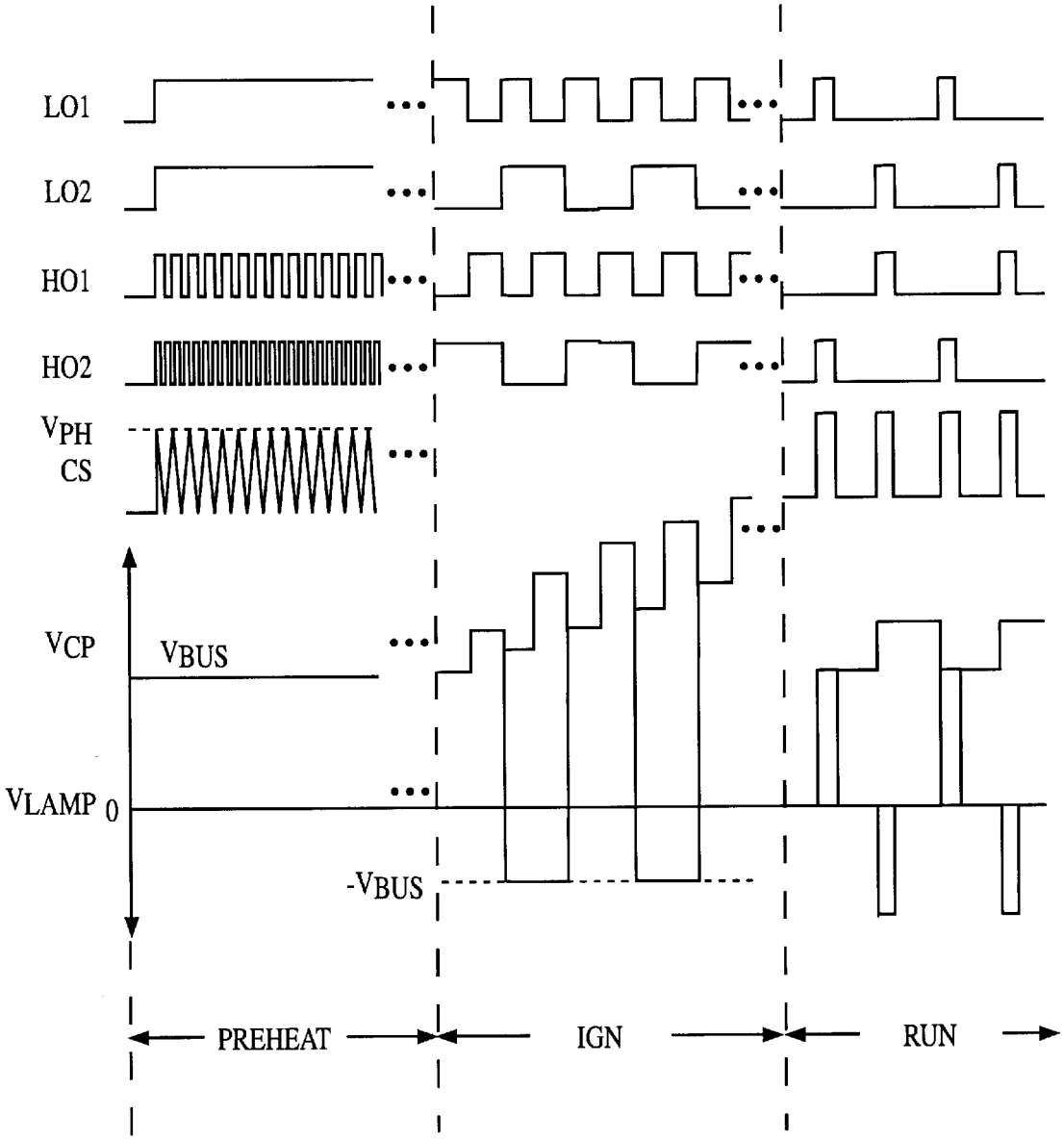
FIG. 8 is a timing diagram for the inductorless ballast circuit of FIG. 7.

During ignition mode, MOSFETs 116 and 118 are switched on and off alternately at a frequency one-half of MOSFETs 112 and 114, as shown by their appropriate control signals LO1, LO2, HO1 and HO2 of FIG. 8.

MOSFETs 116 and 118 must be switched on and off alternately in order to charge the supply voltage necessary to turn switch 116 on. As MOSFETs 112 and 114 are switched on and off alternately, the charge pump circuit, formed of capacitors 136, 138, 140, and diodes 142, 144, and 146, increases the voltage across switching MOSFETs 116 and 118. Each time MOSFET 116 turns on, the high voltage appears across the lamp. The MOSFETs continue to switch in this manner until the lamp ignites and the circuit initiates RUN mode.

Run

During the run mode, the circuit functions substantially as previously described above in connection with FIG. 3.

The lamp current is sensed across resistor 130 and subtracted from a reference voltage $I_{LAMPREF}$. The resulting error voltage, E, is used to control the off-time of the full-bridge switches by converting the error voltage E into a current used to discharge timing capacitor 148. Operational amplifier 150 converts error voltage E into a current which is then mirrored around with transistors 152, 154, 156 and 158 to discharge timing capacitor 148.

The gain of this off-time control is adjusted with the resistor 160. The on-time of the full-bridge switches is controlled using a voltage measurement of the DC bus through resistors 162 and 164, and converting this voltage to a current used to charge timing capacitor 148. Operational amplifier 166 is used to convert the voltage divided measurement of the DC bus into a current, and transistors 168 and 170 mirror the current around into 148. Variable resistor 172 controls the gain of the on-time control.

As timing capacitor 148 charges and discharges linearly between an upper and lower threshold, the oscillator converts this triangular waveform into a rectangular pulse. The driver logic then converts the pulse into the appropriate timing pulses necessary for correctly controlling the full-bridge switches as previously discussed.

Summer 180 can be realized by an operational amplifier feedback circuit or other basic standard solutions known by those skilled in the art of electronic design. The oscillator, driver logic and half-bridge drivers are also basic standard solutions known by those skilled in the art of electronic power supply design.

The inductorless ballast of the present invention provides the following significant advantages:

- Lamp driven with a high frequency AC step-type voltage and current or optimized lamp waveforms (i.e., elliptical).
- Efficient control means for controlling lamp power (i.e., lamp brightness) by varying the operating frequency, the duty-cycle and/or the AC step-type voltage amplitude.
- Sensing and controlling rms, average or peak lamp current for controlling lamp power.
- AC step-type waveform operation provides minimum lamp current crest factor (~1) and maximum power factor (phase shift between lamp voltage and current ~0), therefore maximizing lamp life.
- Utilizes ionization constant of the lamp to achieve high-frequency switching (lamp acts as pure resistor) and prevent lamp power and current from running away exponentially.
- Reduction of electromagnetic interference (EMI), ringing or harmonies produced during switching by utilizing ionization time constant of the lamp along with proper snubbing techniques.
- Potential direct AC line operation without rectification and power factor correction.
- Simple modeling for prediction of lamp performance using mathematical equations which combine lamp power, ionization time constant, voltage and current.
- Utilize resistance of the lamp to achieve zero-voltage switching by commutating the voltage across each switch through the lamp to zero during a pre-determined deadtime before turning the appropriate switch on.
- Lamp ionization time constant is the time it takes to ionize or de-ionize (remove or replace electrons from mercury atoms) the gas in the lamp. Therefore, if the lamp current goes to zero instantaneously, lamp will remain lit for the duration of the time constant (~1 ms) until the electrons recombine with the gas atoms. The energy will decay exponentially, as described by the following equation:

$$P_L = \overline{P_L} + \tau \frac{d\overline{P_L}}{dt}$$

- Potential integration of entire circuit into one package, including control circuitry, power MOSFETs or IGBTs, rectifying diodes and high-voltage capacitors.
- End package could fit into the base of the lamp socket in the case of compact fluorescent lamps where the ballast and lamp are combined into one package, or, into one of the sockets holding the ends of the lamp in a fixture where the ballast is separate from the lamp.
- Results in a substantial reduction in size, weight, and increases reliability and manufacturability.
- Eliminates the need for an inductor, PCB or other external components necessary with existing solutions.

Although the present invention has been described in relation to particular embodiments thereof, many other variations and modifications and other uses will become apparent to those skilled in the art. Therefore, the present invention is to be limited not by the specific disclosure herein, but only by the appended claims.

What is claimed is:

1. An inductorless ballast for a fluorescent lamp, comprising:

(a) a plurality of upper and lower transistor switches arranged in a full-bridge circuit for generating an AC step-type voltage from a DC voltage on a DC bus and supplying said AC step-type voltage power to said fluorescent lamp without an inductor; and (b) a circuit coupled to respective gate inputs of said transistor switches for providing and independently controlling appropriate on and off gate drive signals to said upper and lower transistor switches such that said upper and lower transistor switches alternately conduct with a deadtime therebetween to generate said AC step-type voltage, said AC step-type voltage being directly applied across said fluorescent lamp to power said fluorescent lamp.

2. An inductorless ballast as recited in claim 1, wherein said plurality of transistor switches comprise four transistors.

3. An inductorless ballast as recited in claim 1, wherein said transistor switches comprise MOSFETs.

4. An inductorless ballast as recited in claim 1, wherein said transistor switches comprise IGBTs.

5. An inductorless ballast as recited in claim 1, further comprising circuiting for providing preheat, ignition and running modes of operation.

6. An inductorless ballast as recited in claim 1, wherein said circuit for providing appropriate gate signals comprises one or more half-bridge drivers.

7. A method for supplying power to a fluorescent lamp without employing an inductor, comprising the steps of:

(a) arranging a plurality of transistor switches in a full-bridge circuit configuration for generating an AC step-type voltage from a DC voltage on a DC bus;

(b) applying a voltage across said full-bridge circuit; and (c) providing and independent controlling appropriate on and off gate drive signals to said plurality of transistor switches to generate said AC step-type voltage in which the upper and lower transistor switches of said full-bridge alternately conduct with a deadtime therebetween, said AC step-type voltage being applied across said fluorescent lamp to drive and control operation of said lamp.

8. A method as recited in claim 7, further comprising a preheat mode in which said on and off gate drive signals are controlled such that the deadtime between the conduction of said upper and lower transistor switches approaches zero, resulting in the generation of a shoot-through current through the switches and to the lamp, and subsequent ignition of said lamp.

* * * * *